United States Patent [19]

Mallek et al.

[11] 4,194,455

[45] Mar. 25, 1980

[54] METHOD OF AND FURNACE FOR BURNING WASTE MATERIAL

[75] Inventors: Heinz Mallek, Linnich-Tetz; Dorothee Ermisch, Jülich; Werner Jablonski, Linnich-Tetz, all of Fed. Rep. of Germany

[73] Assignee: Kernforschungsanlage Jülich, Gesellschaft mit beschränkter Haftung, Jülich, Fed. Rep. of Germany

[21] Appl. No.: 930,515

[22] Filed: Aug. 3, 1978

[30] Foreign Application Priority Data

Aug. 3, 1977 [DE] Fed. Rep. of Germany ..... 2734973

[51] Int. Cl.[2] ..... F23G 5/12

[52] U.S. Cl. ..... 110/251; 110/346

[58] Field of Search ..... 110/346, 251, 255; 431/5

[56] References Cited

U.S. PATENT DOCUMENTS

| | | | |
|---|---|---|---|
| 3,785,304 | 1/1974 | Stookey | 110/346 |
| 3,918,372 | 11/1975 | Schuster | 110/346 X |
| 4,048,927 | 9/1977 | Mallek et al. | 110/251 |
| 4,050,389 | 9/1977 | Von Dreusche | 110/346 X |
| 4,116,136 | 9/1978 | Mallek et al. | 110/346 |

*Primary Examiner*—Edward G. Favors

*Attorney, Agent, or Firm*—Becker & Becker, Inc.

[57] ABSTRACT

A method of and furnace for burning waste material. The furnace has a central chute for receiving the waste material, and a combustion chamber which is arranged below the chute and has a closed bottom. The transition between the central chute and the combustion chamber is designed as a constriction. The waste material is accumulated above the constriction, where it is dried and degasified up to the point of combustion by being heated up under the exclusion of air in the central chute. Heated up fresh air is supplied ahead of the constriction at below stoichiometric ratio to the heated up waste material and to the exhaust gases formed during the heating up of the waste material. The exhaust gases are withdrawn downwardly through the constriction, and further fresh air is supplied to the exhaust gases and to the degasified waste material for their common combustion at the constriction, so that essentially only ashes pass downwardly into the combustion chamber through the constriction. Fresh air supply lines discharge at the constriction and in the lower portion of the chute above the constriction. A portion of the combustible gases resulting during the degasification and the destructive distillation of the waste material are removed at the constriction. The flue gases formed in the combustion chamber are guided to a flue through discharge openings in the exhaust chamber of the combustion chamber. The exhaust chamber is designed in such a way that it surrounds the central chute. A device is provided in this chute for storing the waste material. Conduits, which extend into the chute from outside and are connectable to a suction device, discharge at the constriction.

4 Claims, 3 Drawing Figures

METHOD OF AND FURNACE FOR BURNING WASTE MATERIAL

Figure 1:
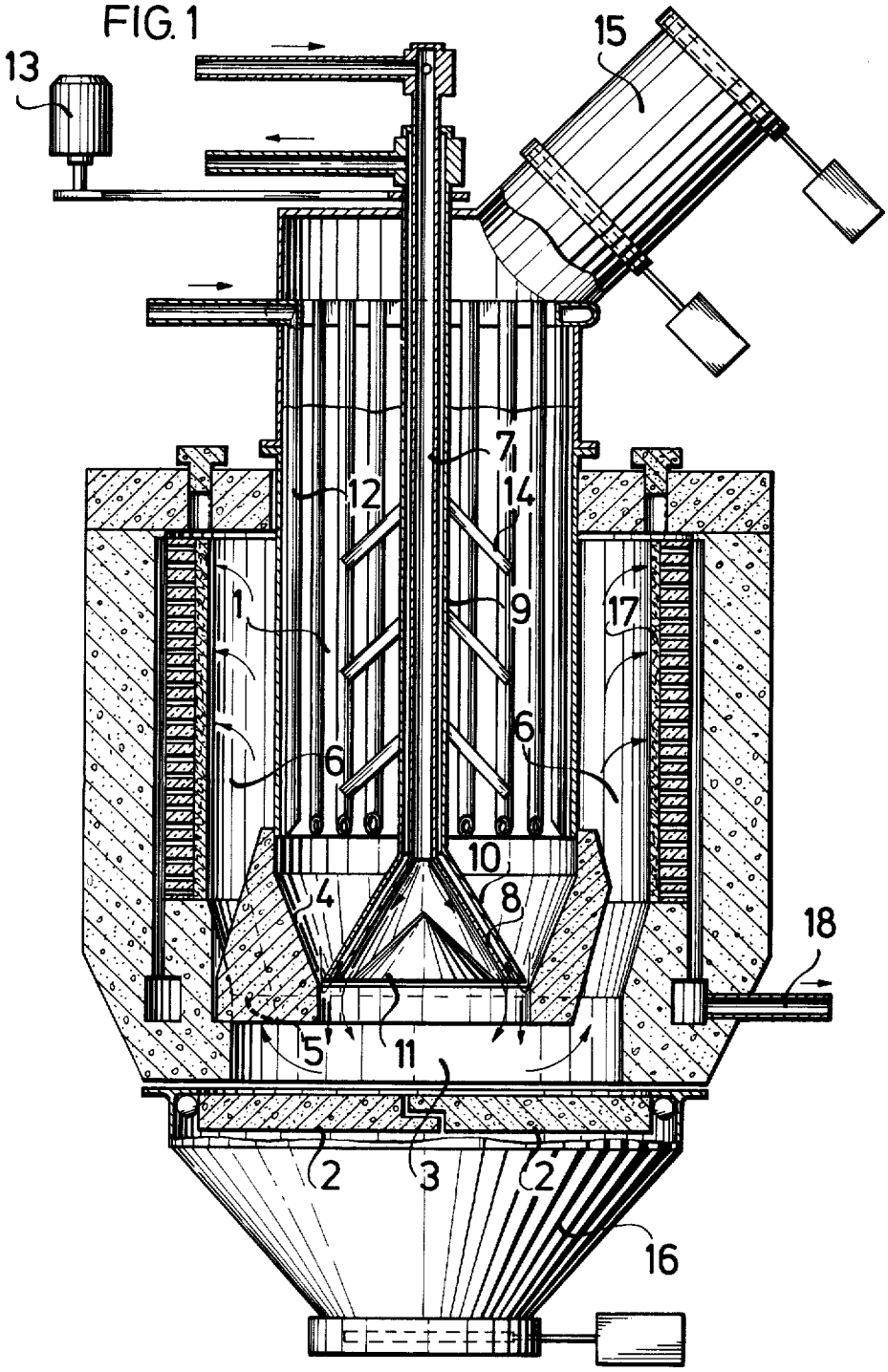

The present invention relates to a method of burning waste material, and starts from the method disclosed in assignee's allowed patent application Ser. No. 764,915 U.S. Pat. No. 4,116,136. The waste material is accumulated above a constriction provided between a chamber which receives the waste material and a combustion chamber which directly follows said last mentioned chamber. The waste material is dried and degasified by being heated up under the exclusion of air in the chamber which receives the waste material. Heated up fresh air is supplied ahead of the constriction at below stoichiometric ratio to the heated up waste material and to the exhaust gases formed during the heating up of the waste material. The exhaust gases are withdrawn downwardly through the constriction, and additional fresh air is supplied to the exhaust gases and to the degasified waste material for their common combustion at the constriction, so that essentially only ashes pass downwardly into the combustion chamber through the constriction.

The present invention also relates to a furnace for burning waste material, starting from assignee's allowed patent application Ser. No. 764,915. The furnace has a central chute for receiving the waste material, and a combustion chamber which is arranged below the chute and has a closed bottom. The transition between the central chute and the combustion chamber is designed as a constriction in such a way that the waste material remains above the constriction in the central chute for drying and degasification and up to the point of combustion. Essentially, only ashes pass through the constriction downwardly into the combustion chamber. The gases which are withdrawn downwardly out of the chute are also guided through the constriction into the combustion chamber. Fresh air supply lines discharge at the constriction and in the lower portion of the chute above the constriction. The flue gases formed in the combustion chamber are guided to a flue through discharge openings in the exhaust chamber of the combustion chamber. The exhaust chamber is designed in such a way that it surrounds the central chute. A device is provided in the chute for stirring the waste material.

Great Britain Patent No. 1365125 discloses a method according to which the waste material is accumulated above a constriction provided between a chamber which receives the waste material and a combustion chamber which directly follows the receiving chamber. The waste material is dried and degasified in the receiving chamber by being heated. The exhaust gases formed during the drying and degasification are burned in the combustion chamber amid the supply of fresh air. With this known method, the fresh air introduced into the combustion chamber is conducted upwardly into the waste column. The fresh air passes a grid element arranged between the chamber provided for receiving the waste material and the combustion chamber. The grid element, with regard to the waste material but not with regard to the gases, forms a constriction between itself and the adjacent wall. This occurs only to the extent that, starting from the constriction, the waste material discharges into a fill. The gases formed in the waste column are, according to the known method, likewise withdrawn upwardly, and in particular through the colder part of the waste column, are then supplied to apparatus for processing the gases, and are only then utilized for the combustion of the waste material.

In contrast, pursuant to assignee's previously mentioned allowed patent application Ser. No. 764,915, the waste material is first heated under the exclusion or absence of air, which results in a drying and degasification of the waste material, and thereby a thermal decomposition of the waste material. As a consequence, combustible pyrolysis gases and residues are formed, which comprise coke and inert materials of the waste material. Since the exhaust gases are withdrawn downwardly through the constriction into the combustion chamber, the exhaust gases, according to the method of the above mentioned patent application, pass downwardly in the waste column and are thereby further conducted in the direction of the increasing temperature gradient. As a result, the partially burned or low temperature carbonization gases are cracked in the increasing heat to short-chained hydrocarbon molecules, which are then, in the subsequent combustion step, easily and completely burned without leaving behind tar-containing residues.

Pursuant to patent application Ser. No. 674,915, heated-up fresh air is supplied to the combustible pyrolysis gases and the degasified waste material above the constriction at below stoichiometric ratio, and the exhaust gases are withdrawn downwardly through the constriction. In this connection, cold fresh air can be fed in from the outside, which, however, on the way towards the discharge of the fresh air conduit, is heated up. By means of the supply of fresh air, the waste material above the constriction is partially burned and the degasification of the waste material is intensified. In addition, in the thereby formed heat bed above the constriction, since the fresh air supply takes place at below stoichiometric ratio, a destructive distillation or coking of the waste material is effected. By supplying the fresh air at below stoichiometric ratio, the up-to-now purely endothermic process is additionally changed to an exothermic process. The energy released by the partial combustion of the combustible gases as well as the combustible waste material, is used for the destructive distillation of the less combustible portions of the waste material, and the waste material is converted into a homogeneous form. This process is further aided in that it leads to a water gas reaction by means of the moisture, which is withdrawn from above and comes from the waste material, in the heat bed located above the constriction. By altering the amount of fresh air which is supplied, it is possible in a simple manner to also practically completely destructively distill waste material which is more difficult to burn. Together with the exhaust gases, which also contain the low temperature carbonization gases converted into an easily combustible form, the now likewise easily combustible waste material is supplied to the constriction and thereby to the combustion.

Pursuant to the above mentioned patent application, additional fresh air is supplied to the combustible gases and to the degasified waste material for their common combustion at the constriction. By means of this method step, the process is changed to an exothermic one. In this connection, by changing the quantity ratios of the primary air which is introduced above the constriction and the secondary air which is supplied at the constriction itself, it is possible in a simple manner to control the combustion and thereby determine the burning behavior of the furnace. The holding back of the waste material above the constriction located between the chamber which receives the waste material and the combustion chamber goes hand in hand with optimally adjusting the individual method steps of drying, degasifying, destructively distilling, and burning the waste material. In this way, it is possible to optimally affect the coking process, and especially, however, the combustion process itself, by controlling the supply of fresh air.

It is an object of the present invention to further improve the method of the above mentioned patent application, especially so that an even more optimum utilization of the thermal energy contained in the waste material may be achieved. It is a further object of the present invention to provide a furnace for carrying out the method of the present invention.

Figure 2:
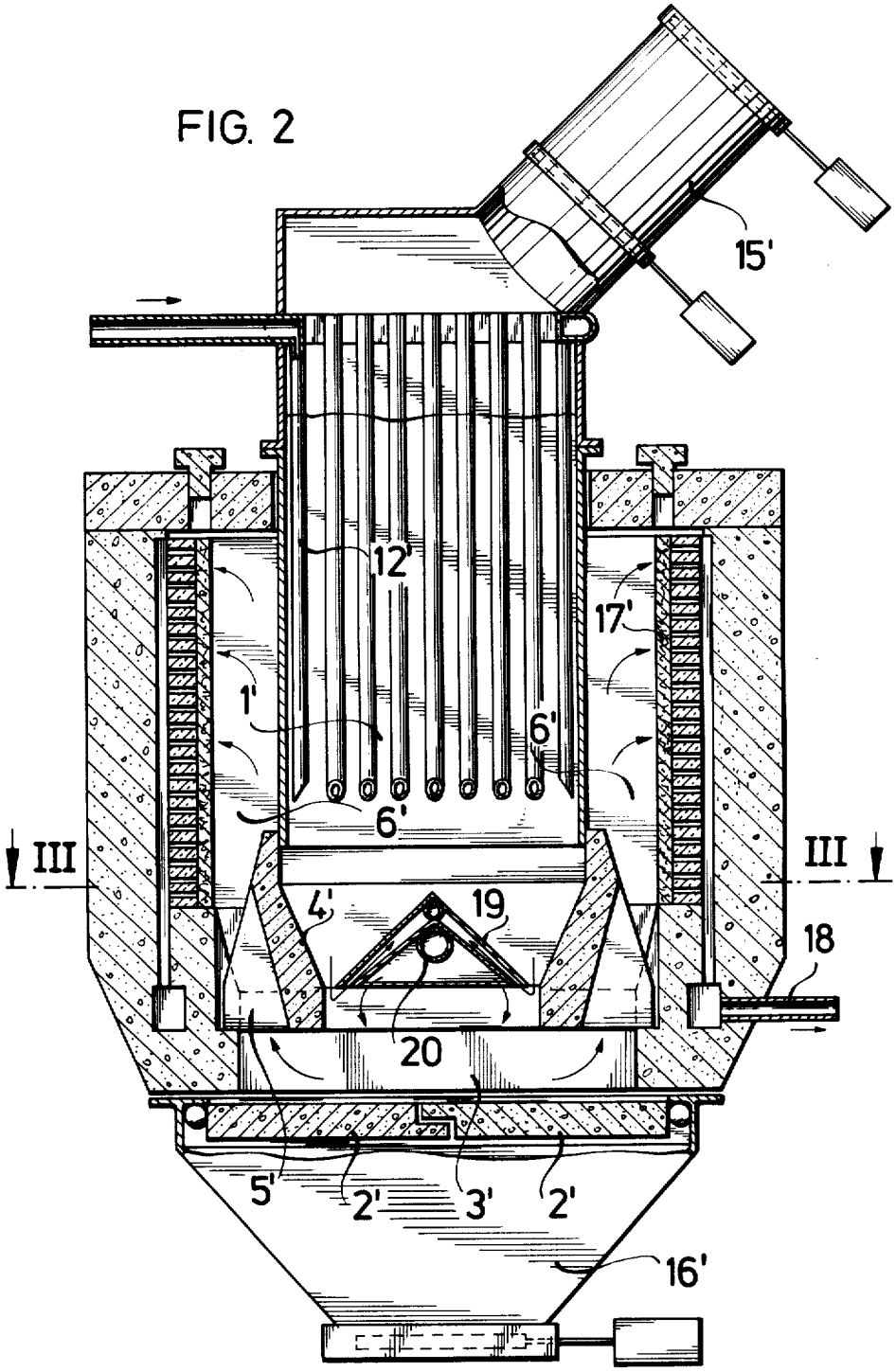
Figure 3:
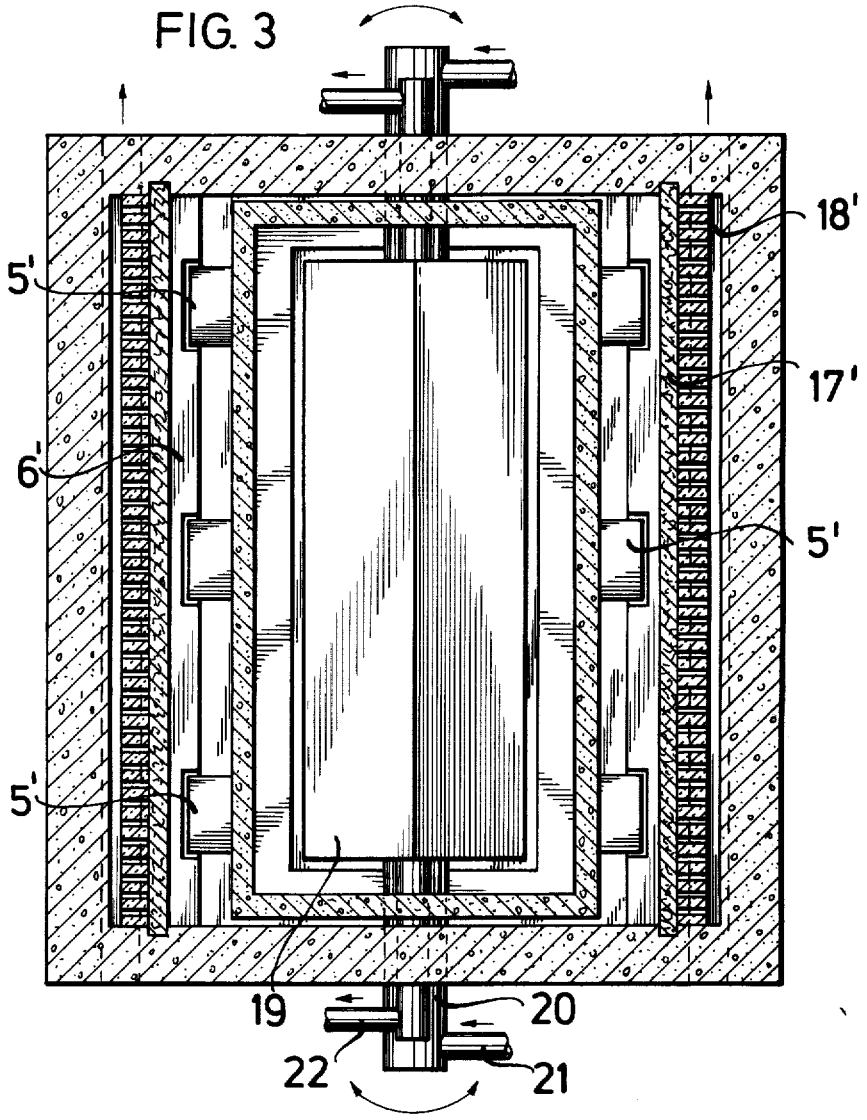

These and other objects and advantages of the present invention will appear more clearly from the following specification in connection with the accompanying drawings, in which:

FIG. 1 schematically illustrates one specific embodiment according to the present invention of a furnace for waste material;

FIG. 2 schematically illustrates another specific embodiment according to the present invention of a furnace for waste material; and FIG. 3 is a section taken along the line III—III of the furnace of FIG. 2.

The method of the present invention is characterized primarily in that a portion of the combustible gases resulting during the degasification and the destructive distillation of the waste material are removed at the constriction. In this way, an even better control of the burning behavior of the waste material is possible. For in addition to the possibility of controlling the quantity ratio between the fresh air introduced above the constriction and at the constriction itself, there is the further possibility of drawing off excess combustible gas which is not required for maintaining the combustion process. Pursuant to the present invention, this takes place at the constriction, i.e., at that place at which the proportion of easily combustible gases in the exhaust gas, such as $CH_4$ CO, and $H_2$, is the largest.

A particularly advantageous variation of the method of the present invention consists in that, to aid the degasification and destructive distillation of the waste material which takes place in the lower portion of the chamber, water vapor and/or water is added to the fresh air which is supplied at below stoichiometric ratio. In this way, by means of the water gas reaction, the formation of combustible gases is further advanced.

The furnace for carrying out the method of the present invention is characterized primarily in that conduits, which extend into the chute from outside and are connectable to a suction device, discharge at the constriction. The excess combustible gas which is not needed for the process of burning the waste material is removed from the combustion process through these conduits.

According to one specific embodiment of the furnace of the present invention, conduits, which are connectable to a water or water vapor supply, discharge in the central chute above the constriction. As a result, water vapor or water can be supplied to the heat bed to promote the water gas reaction.

Referring now to the drawings in detail, a central chute 1 is provided for receiving the waste material. A combustion chamber 3, which can be closed off by flaps 2, is directly connected to the chute 1. The lower portion of the central chute 1 is formed by a furnace muffle 4 which is supported on supports 5, only one of which is shown in the drawing. An exhaust chamber 6, which surrounds the central chute 1, is connected to the combustion chamber 3.

In the specific embodiment shown in FIG. 1, a centrally guided pipe 7 projects into the chute 1 from above. The bottom end of the pipe 7 widens into a conical portion 8. The pipe 7 is coaxially surrounded by a wider pipe 9, and the portion 8 of the pipe 7 is similarly coaxially surrounded by a wider conical portion 10 of the pipe 9. The conduit formed between the pipes 7 and 9 and the portions 8 and 10 is connected with a suction device (not shown in the drawing). During operation of the furnace, excess combustible gases are sucked or drawn off through this conduit. The portion 10 at the same time serves for backing up or accumulating the waste material found in the upper and middle portion of the central chute 1. In this connection, the portions 8 and 10 are shaped in such a way that between these portions and the wall of the furnace muffle 4 a constriction in the form of an annular gap is formed. The cross sectional opening of this gap is such that only ashes or small pieces of coke can pass through the gap. By lifting the pipes 7 and 9 at the same time, the cross sectional opening can be changed, thereby being able to predetermine the size of the coke pieces which pass into the combustion chamber 3. Furthermore, a cone 11 is placed in the portion 8 in such a way that it forms slots with the lower end of the portion 8. Fresh air is guided to the constriction through the pipe 7 and these slots. To supply fresh air into the waste column above the constriction, further pipes 12 are provided along the inner wall of the central chute 1. These pipes 12 are connectable to a supply of water or water vapor (not shown in the drawing).

The pipe 9 is rotatably mounted, and can be turned by means of a drive 13. Since rod-shaped elements 14 are attached to the pipe 9, it is possible, by burning the pipe 9, to stir the material found in the waste column, thereby changing the material over.

During operation of the furnace, the central chute 1 is filled with waste material from a charging box 15 up to about a level which corresponds to the wavy line shown in FIGS. 1 and 2. In the upper and middle portions of the chute 1, the waste material is dried and degassed by means of the heat which passes from the exhaust chamber 6 into the waste column. After supplying fresh air through the pipes 12, a reduction in volume of the waste material takes place in the heat bed in the region above the constriction as a result of destructive distillation, and a reduction in size of the material takes place there as a result of embrittlement. At the constriction itself, amid the supply of fresh air through the pipe 7, the destructively distilled waste material is burned. Ashes and pieces of coke which fall from the flaps 2 are carried along by the oxygen-containing combustion gases which flow toward the bottom. These ashes and coke pieces are then completely burned. After the flaps 2 are opened, the sterile ashes pass into a receptacle 16 provided for receiving the ashes. The exhaust gases pass from the combustion chamber 3 into the exhaust chamber 6, through the hot gas filter 17, and then into the withdrawal line 18 and toward the outside. Any solid materials carried along in the exhaust gases as suspensions are deposited on the filters 17, and are completely burned there under the influence of the hot oxygen-containing exhaust gases. In this connection, the filters may, for example, comprise ceramic orifice plates having mats or ceramic fibers arranged on the plates in the direction of the arriving exhaust gases.

FIG. 2 shows a variation of the furnace of the present invention. Aside from the basic shape, this variation differs from the furnace shown in FIG. 1 primarily in that the device for stopping or accumulating the waste material is formed as the sluice element 19 having a triangular cross section. FIG. 3 shows a top view of this sluice element 19, which is pivotally mounted about an axis 20 and may be pivoted about 15°. By means of the movement of the sluice element 19, the waste material is stirred and reduced in size, thereby assuring a sufficient supply of waste material to the constriction. A conduit 21 which is guided through the axis 20 into the sluice element 19, is provided for supplying fresh air to the constriction. A conduit 22, which is likewise guided through the axis 20, is provided for removing conbustible gas from the constriction.

With a furnace of the above described type, waste material having a heat value of about 3000 Kcal/kg was burned. The major portion of the waste material comprised paper and synthetic material. Further constituents were moist leaves, animal carcasses, and inert materials such as cans and glass bottles. The furnace operated at a throughput of 100 kg waste material per hour. Combustion gas having an energy content of up to 40% of the energy content of the inserted waste material was removed at the constriction.

The present invention is, of course, in no way restricted to the specific showing of the drawings, but also encompasses any modifications within the scope of the appended claims.

What is claimed is:

1. A method of burning waste material, which includes in combination the steps of: heating said waste material while preventing access of air thereto to thereby form waste gases and degasified waste including combustible gases; passing in a flow the thus formed waste gases and degasified waste to an area of combustion; constricting said flow in a location prior to its reaching said area of combustion while admixing fresh air at a below stoichiometric quantity ratio to said flow to destructively distill said waste material to form further combustible gases; admixing additional fresh air to said flow so that both said waste gases and said degasified waste are combusted in common at said constricting location; and removing a portion of said combustible gases from said constricting location.

2. A method according to claim 1, which includes the step of adding at least one of the group consisting of water vapor and water to said admixed fresh air.

3. A furnace for burning waste material, which includes in combination: a chute for receiving said waste material to be burned, said chute having a lower open end; a combustion chamber arranged below said lower end and provided with a normally closed bottom; a furnace muffle extending from said lower open end of said chute to said combustion chamber; first conduit means connectable to a source of fresh air and forming said constricting location with said furnace muffle, said first conduit means leading to said constricting location; second conduit means connectable to a source of fresh air and arranged in said chute and ending in said chute above said constricting location for supplying fresh air thereto; flue means surrounding said chute and communicating with said combustion chamber for releasing flue gases therefrom; means arranged in said chute for aiding the movement of said waste material to be burned through said chute; and third conduit means extending from the outside of said chute into said chute, said third conduit means opening at said constricting location and connectable to a withdrawal device for withdrawing said combustible gases from said constricting location.

4. A furnace according to claim 3, which includes fourth conduit means arranged inside said chute, ending above said constricting location, and connectable to a source of one of the group consisting of water vapor and water.

* * * * *